US006679450B2

(12) United States Patent
Corres

(10) Patent No.: US 6,679,450 B2
(45) Date of Patent: Jan. 20, 2004

(54) TUBE FEEDING DEVICE FOR A WORK STATION OF A CHEESE-PRODUCING TEXTILE MACHINE

(75) Inventor: Norbert Corres, Wegberg (DE)

(73) Assignee: W. Schlafhorst AG & Co. (DE)

( * ) Notice: Subject to any disclaimer, the term of this patent is extended or adjusted under 35 U.S.C. 154(b) by 32 days.

(21) Appl. No.: 09/977,733

(22) Filed: Oct. 12, 2001

(65) Prior Publication Data

US 2002/0043583 A1 Apr. 18, 2002

(30) Foreign Application Priority Data

Oct. 13, 2000 (DE) ..... 100 50 693

(51) Int. Cl.[7] ..... B65H 54/26; B66C 1/00

(52) U.S. Cl. ..... 242/473.6; 294/88; 294/115

(58) Field of Search ..... 242/473.6, 473.5, 242/473.7, 473.8, 474.2; 294/106, 115

(56) References Cited

U.S. PATENT DOCUMENTS

| | | | | | |
|---|---|---|---|---|---|
| 4,399,951 | A | * | 8/1983 | Preuhs | 242/473.6 |
| 4,598,881 | A | * | 7/1986 | Lattion | 242/473.6 |
| 4,611,767 | A | * | 9/1986 | Oberstrass | 242/473.6 |
| 4,856,270 | A | * | 8/1989 | Langen et al. | 242/473.6 |
| 4,890,799 | A | * | 1/1990 | Grecksch | 242/473.6 |
| 4,923,132 | A | * | 5/1990 | Hirai et al. | 242/473.6 |
| 5,083,716 | A | * | 1/1992 | Colli et al. | 242/473.6 |
| 5,092,532 | A | * | 3/1992 | Meroni et al. | 242/473.5 |
| 5,165,615 | A | * | 11/1992 | Polnik | 242/473.6 |
| 5,588,603 | A | * | 12/1996 | Nakaji | 242/473.6 |
| 5,634,602 | A | * | 6/1997 | Gobbels et al. | 242/473.6 X |
| 5,634,603 | A | * | 6/1997 | Raasch et al. | 242/475.2 |
| 5,937,629 | A | * | 8/1999 | Spindler et al. | 242/473.6 X |
| 6,012,671 | A | * | 1/2000 | Resch | 242/473.6 |
| 6,014,592 | A | * | 1/2000 | Fechter et al. | 242/473.6 X |
| 6,328,247 | B1 | * | 12/2001 | Fechter et al. | 242/473.6 |

FOREIGN PATENT DOCUMENTS

| | | |
|---|---|---|
| DE | 21 57 304 B2 | 12/1976 |
| DE | 21 21 426 B2 | 3/1978 |
| DE | 37 26 508 A1 | 12/1988 |
| DE | 38 40 090 A1 | 6/1989 |
| DE | 195 28 983 A1 | 3/1996 |
| EP | 0 157 654 B1 | 2/1988 |
| EP | 0 126 352 B1 | 8/1988 |

OTHER PUBLICATIONS

German Search Report.
European Search Report.

* cited by examiner

*Primary Examiner*—Michael R. Mansen
(74) *Attorney, Agent, or Firm*—Kennedy Covington Lobdell & Hickman, LLP

(57) ABSTRACT

A tube feeding device (12) for a work station (2) of a cheese-producing textile machine (1) with an arrangement for transferring an empty tube (14) stored in a tube reservoir (13) into a tube transfer position (II) in which the empty tube (14) can be accepted by a pivotably seated creel (19). The tube feeding device (12) has a tube gripper (24) which is automatically adjustable to the diameter and the shape of an empty tube (14) for displacing the central longitudinal axis (57) of the empty tube (14) during the tube transfer operation independently of the shape or the diameter of the empty tube (14) so as to coincide with the common axis of rotation (61) of tube receiving plates (58) of the creel (19) in the tube transfer position (II).

17 Claims, 9 Drawing Sheets

TUBE FEEDING DEVICE FOR A WORK STATION OF A CHEESE-PRODUCING TEXTILE MACHINE

CROSS-REFERENCES TO RELATED APPLICATIONS

This application claims the benefit of German patent application 10050693.3 filed Oct. 13, 2000, herein incorporated by reference.

FIELD OF THE INVENTION

The present invention relates to a tube feeding device for a work station of a cheese-producing textile machine equipped with an arrangement for transferring an empty tube from a tube reservoir into a tube transfer position for placement on a pivotably seated creel.

BACKGROUND OF THE INVENTION

It is known to provide cheese-producing textile machines with traveling service units, also known as cheese changers, which can be moved along the work stations of these textile machines and can be positioned at the individual work stations when needed. Similarly, it is also known to provide such machines with separate changing devices, which are arranged stationarily at the work stations.

For example, a traveling service unit which can be moved along the work stations, can be positioned at the respective work station when needed thereat to replace a finished cheese with an empty tube, is described, for example, in German Patent Publication DE 37 26 508 A1.

This known movable service unit has a multitude of manipulating devices, which are controlled in accordance with a preset program during a change cycle.

Among other things, the service unit has a tube ejection arm which, when needed, transfers the finished cheese to a special conveying device extending over the length of the machine, as well as a tube gripper, which removes an empty tube from a tube reservoir forming part of the work station, and places the empty tube into the creel of the respective work station. In this case, the tube gripper has individual gripper fingers, whose initial position can be manually adjusted in accordance with the tube format to be manipulated.

A comparable service unit is also described in European Patent Publication EP 0 126 352 B1.

This known service unit is provided with a tube feeder arranged on a pivotably seated intermediate frame, which is also quite elaborate. Depending on whether the tube feeder is required to handle cylindrical or conical empty tubes, the intermediate frame can be pivoted into a first or a second operating position. In accordance with European Patent Publication EP 0 126 352 B1, tube holders are also located on the output side of an empty tube reservoir, which can be manually set in accordance with the respective tube diameter.

Since the structural design of such complex operating units as a whole is relatively elaborate and complicated, the manufacture of such units also becomes quite costly.

Therefore various attempts have been made in the past to replace these movable, relatively complicated service units by stationary, simply constructed changing devices at each one of the work stations of a textile machine.

Other textile machines are described in German Patent Publications DE 21 57 304 B and DE 21 21 426 B, for example, each of whose work stations have a creel, which can be pivoted between a winding position and a cheese delivery position.

Moreover, an empty tube reservoir is assigned to the individual work stations, whose outlet can be positioned within the pivot range of the creel in such a way that, after having delivered the finished cheese, the creel can be automatically provided with a fresh empty tube.

A comparable device is also known from European Patent Publication EP 0 157 654 B1.

With this bobbin-winding machine, the individual work stations are also each equipped with a creel which is pivotable between a winding position, a cheese delivery position and an empty tube pickup position.

Each work station is also assigned its own tube reservoir, which can be acted upon by means of a pivot drive mechanism such that the tube at the front in the tube reservoir can be brought exactly to the level of the empty tube pickup position of the creel and can be picked up thereat by the closing creel.

A textile machine with stationary changing devices at each work station, as well as an associated empty tube reservoir, is also represented and described in German Patent Publication DE 195 28 983 A1 embodied in a false twist machine.

However, all of the above described changing devices have the serious flaw that they are only designed for a defined tube format.

Thus the empty tube reservoirs are each designed and arranged such that the empty tube feeding position of the empty tube reservoir corresponds with the empty tube pickup position of the creel only at a defined tube diameter. When changing the tube format, extensive manual adjustment or retrofitting work is respectively required, if this is even possible at all with the known devices.

SUMMARY OF THE INVENTION

In view of the above mentioned known machines and devices, it is an object of the present invention to provide a more simplified and cost-effective device for the introduction of empty tubes, even of different format, into the creels of the work stations of a cheese-producing textile machine.

In accordance with the present invention, this object is attained by means of a tube feeding device for a work station of a cheese-producing textile machine having an arrangement for transferring an empty tube from a storage position in a tube reservoir into a tube transfer position for presentation to a pivotably seated creel between rotatable tube receiving plates thereof. Briefly summarized, the tube feeding device comprises a tube gripper configured to be automatically adjustable to the diameter and the shape of an empty tube for displacing a central longitudinal axis of the empty tube during a tube transfer operation independently of the shape or the diameter of the empty tube such that, in the tube transfer position of the tube transferring arrangement, the central longitudinal axis of the empty tube coincides with a common axis of rotation of the tube receiving plates of the creel.

Briefly summarized, the tube feeding device comprises a tube gripper configured to be automatically adjustable to the diameter and the shape of an empty tube for displacing a central longitudinal axis of the empty tube during a tube transfer operation independently of the shape or the diameter of the empty tube such that, in the tube transfer position of the tube transferring arrangement, the central longitudinal axis of the empty tube coincides with a common axis of rotation of the tube receiving plates of the creel.

The tube feeding device in accordance with the present invention has the particular advantage that such a tube feeding device makes it possible without problems to transfer empty tubes of any arbitrary diameter or of different shapes (cylindrical or conical) to a creel or to change the tube format, without any prior adjustment work being necessary.

Thus, the tube feeding device in accordance with the present invention picks up the respective empty tube with is tube gripper from a preferably stationary tube reservoir, which is a part of the winding head, and conveys it into a tube transfer position, in which it can be taken over by the creel. In the course of this transport, the center longitudinal axis of the empty tube is automatically aligned such that, in the tube transfer position of the tube feeding device, it exactly coincides with the axis of rotation of the tube receiving plate positioned thereat. The empty tube can subsequently be securely grasped between the rotatably seated tube receiving plates when the creel is closed.

In a preferred embodiment, the tube gripper has a pressure application piston, which is seated to be vertically displaceable and is functionally connected with the gripper finger pairs. The gripper finger pairs are themselves fixed on connecting brackets to be rotatable to a limited extent. In this case, the functional coupling of the pressure application piston, or of a pressure application plate tiltably arranged on the pressure application piston, with the gripper finger pairs results in every movement of this pressure application piston and/or plate to lead to a comparable, but oppositely directed movement of the gripper finger pairs.

According to another feature of the invention, the pressure application piston is slidingly guided in a hollow body, for example a cylindrical one, and is cushioned by a spring element. Thus, the spring element acts on the pressure application piston to urge it in an extending direction.

A drive arm of a control linkage which, for example, can be acted upon by the creel of the respective work station, acts on the hollow body, which itself is displaceably seated in an appropriate receiving bore of a base body of the tube gripper.

The hollow body, and also the pressure application piston, can be displaced without problems in the direction toward the empty tube via the drive arm. In the process, the pressure application plate arranged on the pressure application piston is placed on the empty tube by means of the spring force of the spring element between the pressure application piston and the hollow body, and thereby fixes it securely in place.

In an advantageous embodiment, a pressure application plate is arranged on the pressure application piston and is tiltable in respect to the center longitudinal axis of the empty tube and is connected at its end with the gripper finger pairs by means of respective tongue-like pushers. The pressure application plate is automatically matched to the position of the surface of the empty tube, and in the process exactly controls the associated gripper finger pairs automatically via the tongue-like pushers.

According to a further feature of the invention, each of the pushers has an elongated slot guide, which limits the displacement of a carriage- like connecting element. The connecting elements are each connected via control linkages with one of the gripper finger pairs. Thus, the position of the gripper finger pairs is defined by the position of the connecting elements, or by the position of the tongue-like pushers, which in turn are connected to the pressure application plate of the pressure application piston.

Such a direct mechanical coupling of the pressure application piston, or its pressure application plate, with the associated gripper finger pairs constitutes a cost-effective and dependable control arrangement, which makes possible in a simple manner the exact positioning of the center longitudinal axis of an empty tube, independently of the shape and diameter of the picked-up empty tube.

In a preferred embodiment, the connecting elements slide on guide rails formed on the base body. Thus, not only the height position of the connecting elements is dependably preset, but horizontal displacement of the connecting elements is dependably prevented by the guide rails.

It is further preferred that the connecting elements, and therefore the gripper finger pairs, can be fixed in a special basic position by special holding plates, so that a problem-free transfer of an empty tube from the tube reservoir to the tube feeding device is assured.

To this end, the holding plates each have an angled guide slot, which extends over a collar-like shoulder on the connecting elements.

In a first embodiment, the base body of the tube gripper is displaceably seated on a base frame of the tube feeding device.

More specifically, a drive arm of a control linkage preferably acts on the base body of the tube gripper and makes possible a spatial displacement of the tube gripper, as well as its defined actuation.

In this case, the control linkage has, among other things, a control arm which can be acted upon by the pivotably seated creel. It is possible by means of such an embodiment of the tube feeding device to operate the tube gripper by the pivot drive mechanism of the associated creel.

Thus, with the above described design, the tube feeding device requires no drive mechanism of its own.

In an alternative embodiment, a drive mechanism, preferably an electric drive mechanism, is arranged in the area of the base frame. Here, an electric motor is connected with the tube gripper, for example by means of an above described, slightly modified control linkage, and can displace as well as operate the tube gripper.

By the use of such an electric drive mechanism arranged on the base frame of the tube feeding device, it is possible to further accelerate the changing procedure, in particular the introduction of the empty tube into the creel.

In this case, the tube feeding device in accordance with the invention is either stationarily fixed in place at each one of the work stations of a cheese-producing textile machine or is designed as a movable service unit which can be positioned at the appropriate work station when required.

Such an embodiment leads to a textile machine having a large degree of efficiency, since a possible defect of one of the tube feeding devices only impairs the respective work station, while all of the other work stations remain unaffected. Moreover, a textile machine with stationary tube feeding devices at each work station has an inherently high degree of efficiency, since it is possible to immediately initiate the changing process at each work station. If necessary, changing processes can also take place simultaneously at several work stations.

An embodiment wherein the tube feeding device is a part of a traveling service unit has the particular advantage that, as a whole, it is more cost-effective when employing the tube feeding device because it is possible by means of advance planning and control to minimize possibly occurring losses of efficiency. In particular, a tube feeding device embodied in this manner requires considerably less time for supplying a work station than, for example, a mobile cheese-changing unit employed up to now.

Further details, features and advantages of the present invention will be understood from an exemplary embodiment described herein with reference to the accompanying drawings.

DETAILED DESCRIPTION OF THE PREFERRED EMBODIMENT

Figure 1:
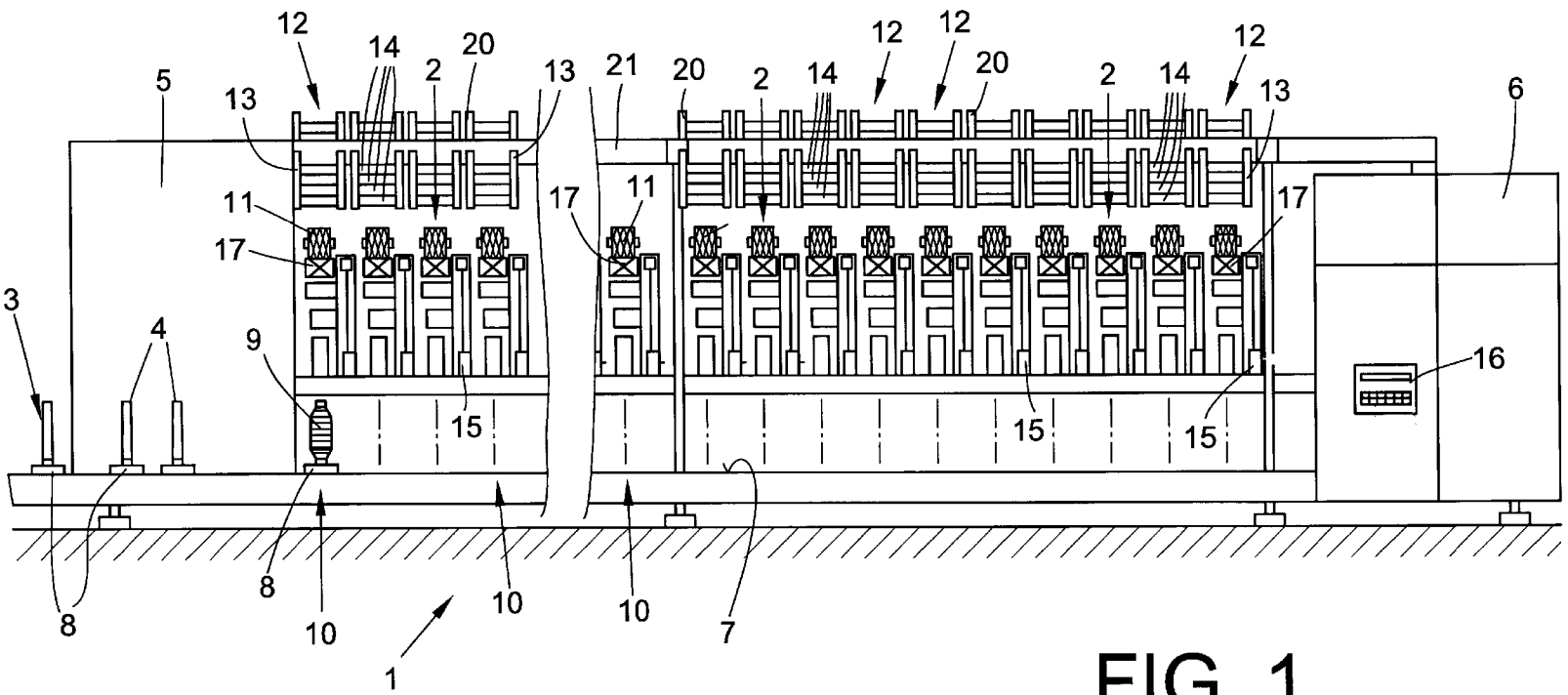
FIG. 1 is a front view of a cheese-producing textile machine with stationary tube feeding devices at the individual work stations, in accordance with the present invention.
Figure 2:
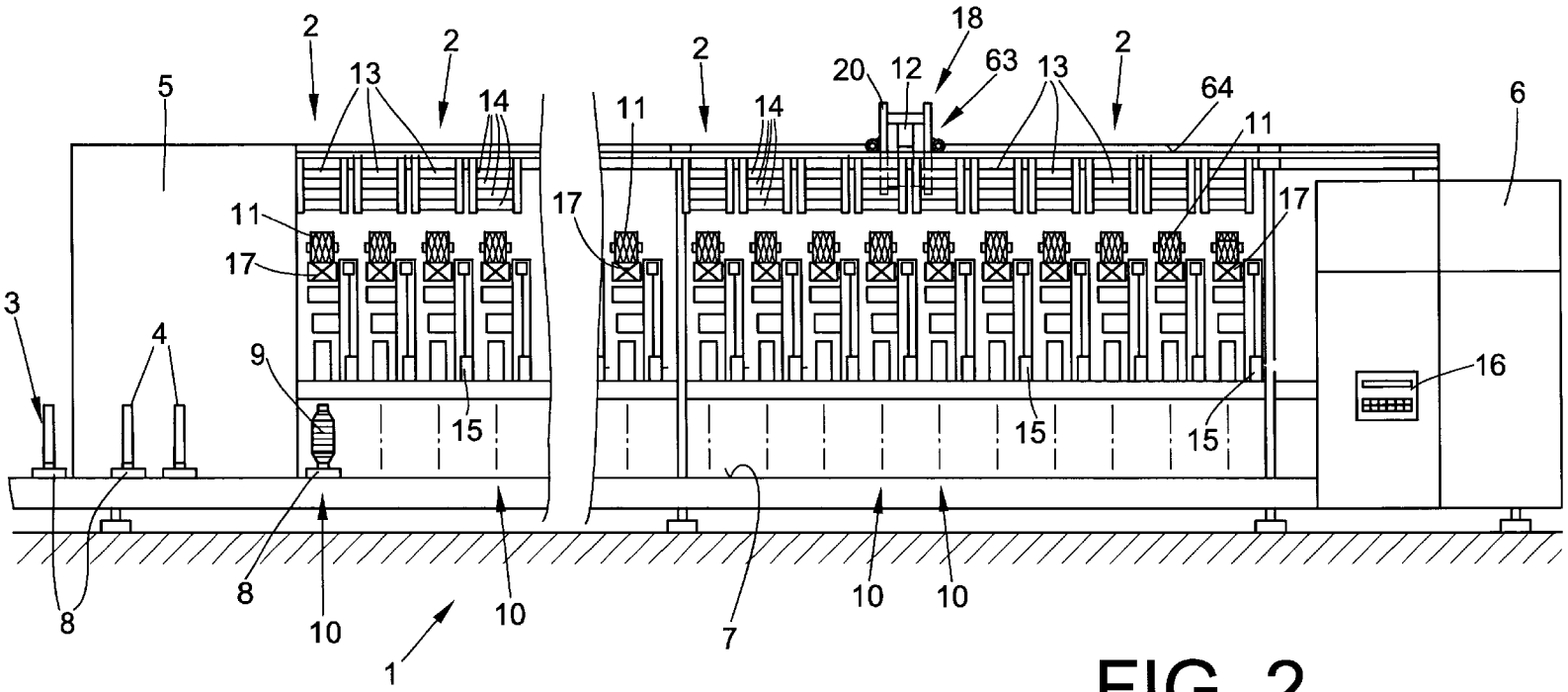
FIG. 2 is another front view, similar to FIG. 1, wherein a tube feeding device in accordance with the present invention is embodied as a traveling service unit which can be moved along the work stations.

A cheese-producing textile machine, in the exemplary embodiment an automatic cheese winder, is represented in a front view in FIGS. 1 and 2 and is identified as a whole by the reference numeral 1. Customarily, such automatic cheese winders 1 have a plurality of identical work stations 2, which are arranged between end frames 5 and 6. Here, the work stations 2 are arranged in alignment adjacent each other and, when required, are accessible from a service path extending along a front side of the textile machine 1.

The cheese winder 1 operates in a known manner, which therefore need not be explained in detail, to rewind spinning cops 9 into large-volume cheeses 11 on these work stations, also called winding heads 2. In the course of the rewinding process, each spinning cops 9 is disposed in an unwinding position 10 located at each respective winding head 2 along a transverse conveying path of travel through the winding head (not represented).

As indicated in FIGS. 1 and 2, the winding heads 2 are supplied and emptied via a bobbin and tube conveying system 3. The spinning cops 9, and the emptied cop tubes 4 once unwound, are supported in vertical orientation on tube conveying plates 8 while being circulated through this bobbin and tube conveying system 3, of which only the tube return path 7 is represented in FIGS. 1 and 2.

Since the spinning cops are not only rewound, but the yam is also checked during the rewinding process and, if required, cleaned, each winding head 2 has a number of special yarn monitoring and processing devices, which are known per se and are therefore not explained in detail.

Therefore, the schematic representation of the individual winding heads 2 is limited in FIG. 1 to the indication of the end product, a so-called cheese 11, a cheese drive roller 17 and a stationary tube feeding device 12 in accordance with the present invention, which is arranged with its base frame 20 on a crossbar 21 extending above the winding devices.

Each winding head 2 furthermore has its own dedicated winding head tube storage reservoir 13 for receiving a number of empty cheese tubes 14 required for producing a cheese 11.

As indicated in FIG. 1, each winding head 2 moreover has its own winding head computer 15 which is connected, for example by means of a bus system (not represented) with a central information system 16 of the textile machine.

The textile machine 1 represented in FIG. 2 differs from the textile machine in accordance with FIG. 1 only by the design of the tube feeding device 12 of the present invention.

In the embodiment of FIG. 2, the automatic winder 1 is provided with only a single tube feeding device 12, in the form of a movable service unit 18, in place of a plurality of stationary tube feeding devices 12 associated respectively with the individual winding heads 2. This service unit 18 is supported by a wheeled running gear 63 affixed to the base frame 20 and rollably mounted on a track 64 extending above the winding heads 2 of the textile machine 1.

In this embodiment, the service unit 18 is preferably connected via a bus line (not represented) with the central information system 16 of the textile machine 1 and can be actuated by the latter in accordance with the requirements at the individual work stations 2.

Figure 3:
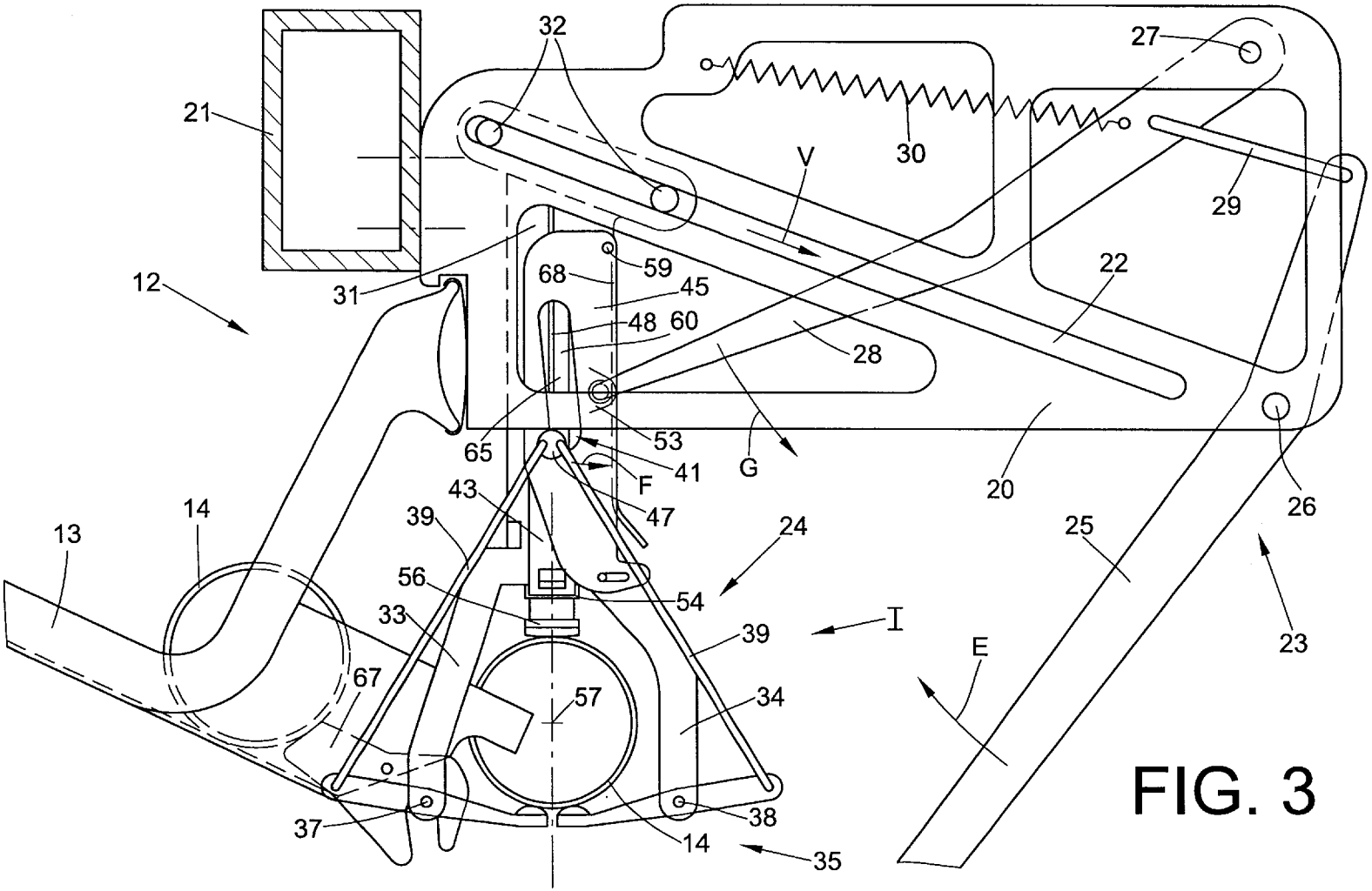
FIG. 3 is a side view of a tube feeding device, whose tube gripper is parked in a tube transfer position.

FIG. 3 shows a lateral view of a tube feeding device 12 in accordance with the invention.

As shown in FIG. 3, the tube feeding device 12 essentially comprises a base frame 20 which, in accordance with the embodiment in FIG. 1, is rigidly fixed in place on a crossbar 21 of the automatic cheese winder 1, a tube reservoir 13 fastened to the base frame 20, as well as a tube gripper 24, which is movably attached to the base frame 20.

More specifically, the base frame 20 has an elongated guide slot 22 for the displaceable seating of the base body 31 of the tube gripper 24.

Furthermore, a control linkage, identified as a whole by the reference numeral 23, is arranged on the base frame 20. The control linkage 23 comprises in detail a control arm 25 with a pivot shaft 26, a drive arm 28 rotatably seated on a pivot shaft 27, as well as an intermediate linkage 29 inserted between the control arm 25 and the drive arm 28. A spring element 30, preferably an extension spring, also acts on the drive arm 28.

As can be seen in FIG. 3, the base body 31 of the tube gripper 24 is conducted by means of sliding rollers 32 or the like within the elongated guide slot 22 of the base frame 20.

Moreover, sealing brackets 33, 34, which support the pivot shafts 37, 38 of the gripper finger pairs 35, 36, are formed on the side of the base body 31 opposite the slide rollers 32. The gripper finger pairs 35, 36 are seated on these pivot shafts 37, 38, to be rotatable to a limited extent and are connected via control linkages 39, or 40, with special connecting elements 41, 42 on the base body 20.

Each of the connecting elements 41, 42 slides on a respective guide rail 48, 49, formed on the base body 31, and has a collar-like shoulder 47 over which extends an elongated receiver slot 60 in a respective tongue-like slide 43, 44, and a guide 65 in a respective one of the support plates 45, 46.

Figure 7:
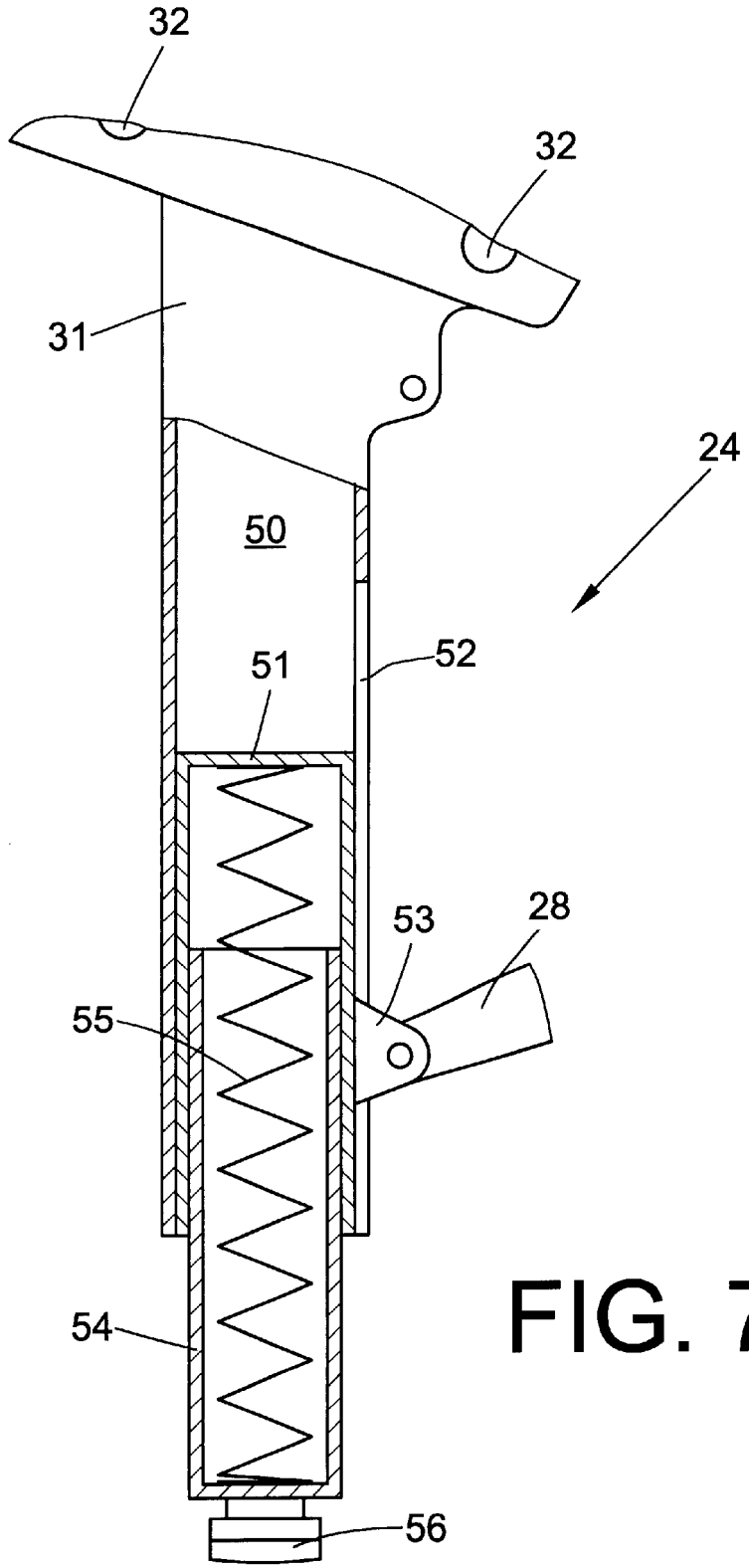
FIG. 7 is a side view of the base body of the tube gripper, partially in cross-section.

As can be seen in particular in FIG. 7, the base body 31 has a receiving bore 50, which is open toward the bottom and is preferably slit longitudinally at 52. A hollow body 51 is displaceable seated in this receiving bore 50, and has a connecting bracket 53 which passes outwardly from the receiving bore 50 and is connected with the drive arm 28 of the control linkage 23. Moreover, a pressure application piston 54, on which a spring element 55 acts, is displaceably seated inside the hollow body 51. On its end, the pressure application piston 54 has a pressure application plate 56, which is seated to be tiltable in the direction of the longitudinal axis 57 of the tubes 14, and to which the tongue-like slides 43, 44, are connected.

Figure 8:
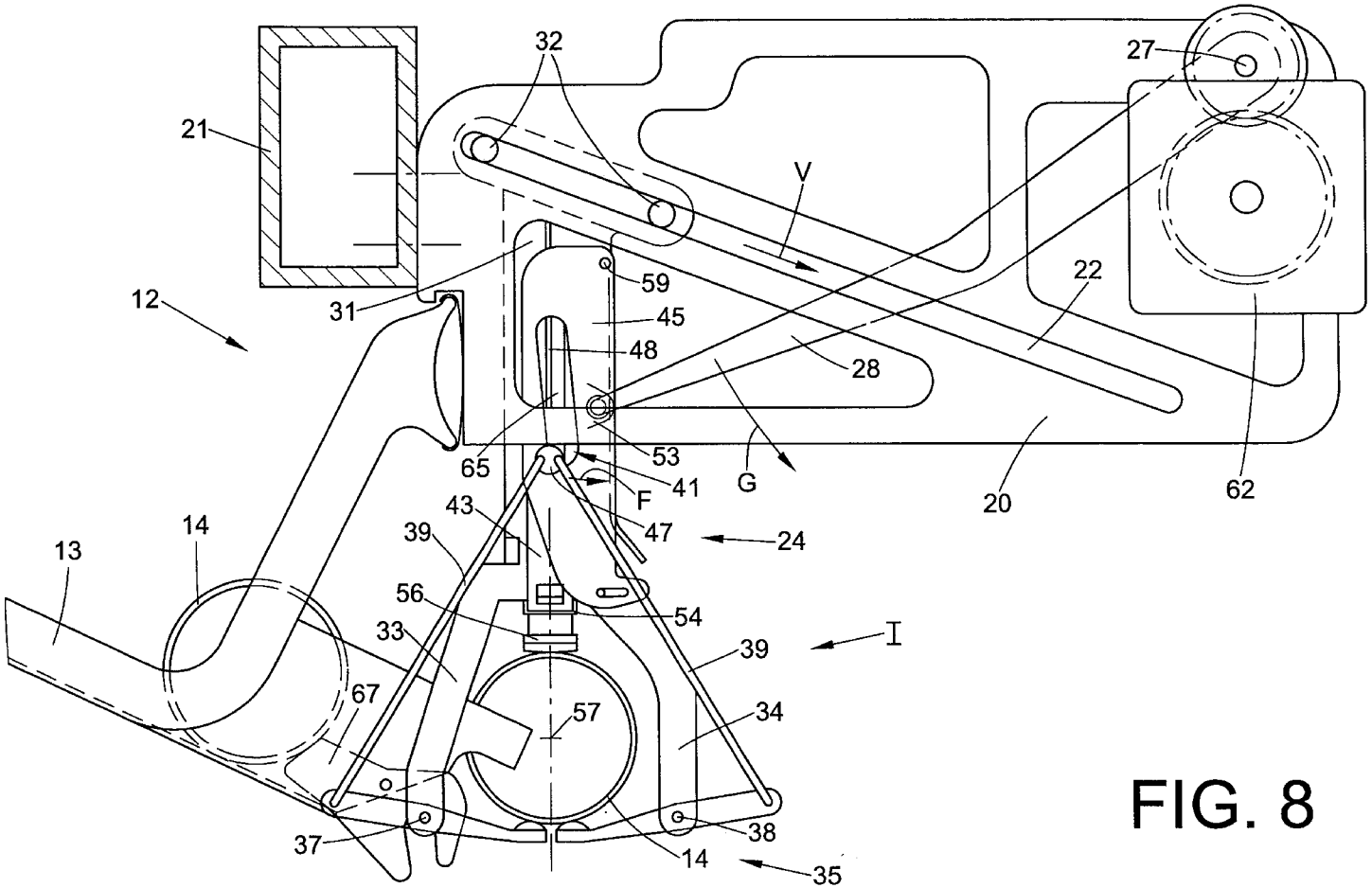
FIG. 8 is a side view of a tube feeding device in accordance with a further alternative embodiment of a tube feeding device.

Actuation of the tube feeding device 12 takes place either via the creel 19, which acts on the control arm 25 of the control linkage 23, as represented by the embodiment of FIG. 3, or via a separate drive mechanism 62 which is attached to the base frame 20 of the tube feeding device 12, as represented by the embodiment of FIG. 8.

The drive mechanism 62 is preferably in the form of an electric motor and serves to actuate the displacement of the tube gripper 24 inside the base frame 20, as well as the functionally correct actuation of the tube gripper 24. It is of course also possible to provide several drive mechanisms for the displacement and actuation of the tube gripper 24 in place of a common drive 62.

Thus, the base frame can have a drive mechanism for moving the tube gripper 24 inside the base frame 20, and a further, separate drive mechanism for actuating the tube gripper 24.

However, this embodiment variation is not represented in the drawings.

The operation of the device of the present invention will thus be understood, with reference to the exemplary embodiment in accordance with FIG. 1.

When a cheese 11 at one of the winding heads 2 of the textile machine 1 has reached its prescribed preselected size (e.g., a preselected diameter or preselected yam length), which is detected by the associated winding head computer 15, the respective winding head 2 is stopped and the yarn being unwound from the spinning cop 9 onto the cheese 11 is made ready in a known manner for producing a new cheese.

Thereafter the creel 19 is pivoted from its winding position into a tube transfer position by means of an appropriate drive mechanism (not represented), and the finished cheese 11 is transferred to a cheese conveying arrangement (not represented) extending behind the winding heads 2 over the length of the machine.

At this time, the tube gripper 24 of the tube feeding device 12 is disposed in the tube receiving position I, which is represented in FIG. 3.

More specifically, a fresh empty tube 14 is kept ready within the inwardly pivoted pairs of gripper finger 35, 36.

As indicated in FIG. 3, the gripper finger pairs 35, 36 are fixed in place in this position by the support plates 45, 46. More specifically, limit stops at the connecting bracket 53 of the hollow body 51 act in the direction F on the angled rear sides 68 of the support plates 45, 46. In this manner, the support plates 45, 46 are pivoted around their pivot point 59 such that the shoulder 47 of the connecting brackets 41, 42, on which the control linkages 39, 40 of the gripper finger pairs 35, 36 are hinged, is fixed in the angled portion of the support plate guide 65.

After the cheese 11 has been transferred onto the cheese conveying arrangement, the creel 19 is pivoted back into its winding position and in the process acts on the control arm 25 of the control linkage 23 in the direction E.

Figure 4:
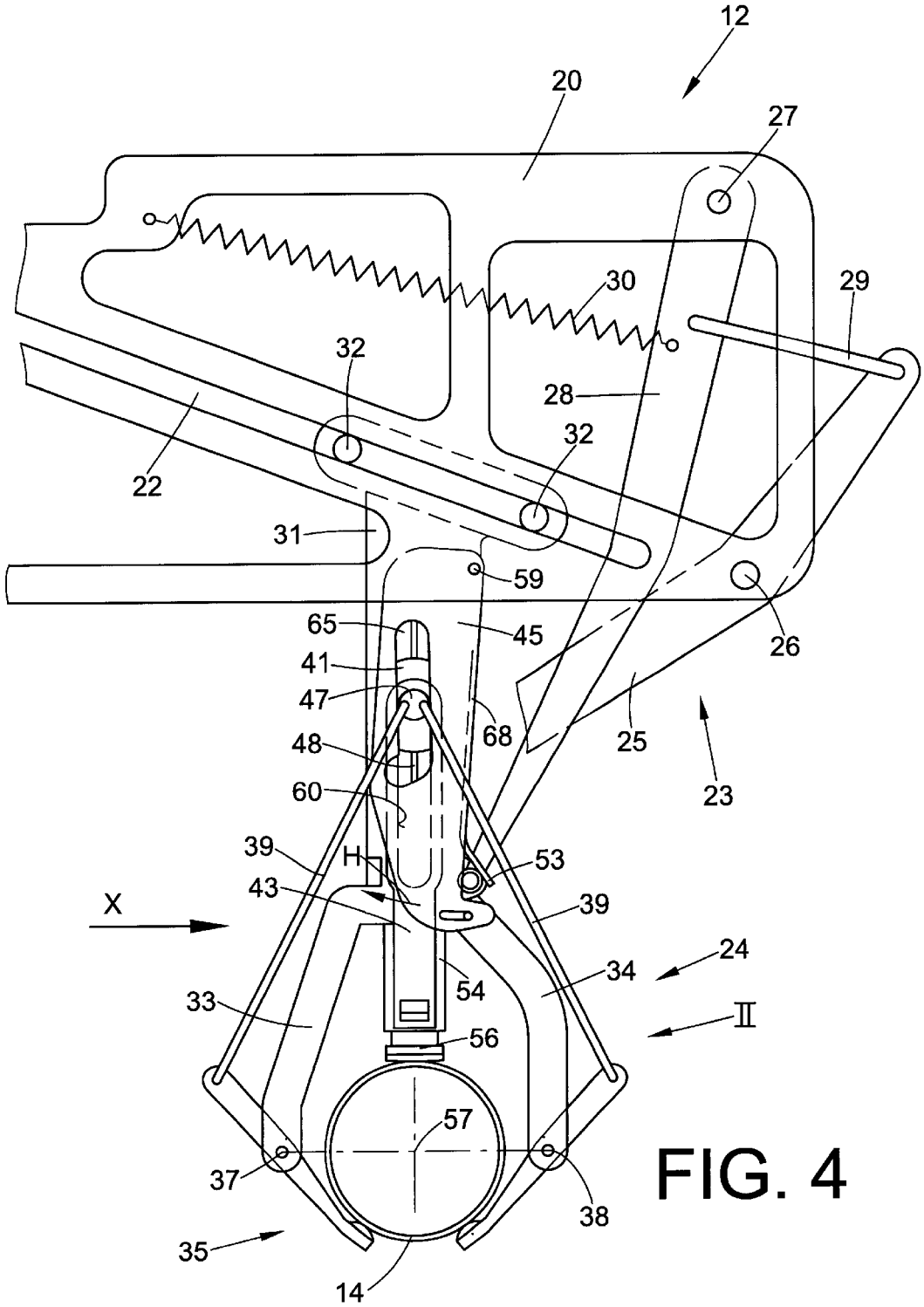
FIG. 4 is another side view of the tube feeding device of FIG. 3, showing the tube gripper in a tube transfer position.

This pivoting movement of the control arm 25 is transferred via the intermediate linkage 29 to the drive arm 28, which thereupon is pivoted downwardly in the direction G. The downwardly pivoting drive arm 28 is connected to the connecting bracket 53 of the hollow body 51, and thereby displaces this hollow body 51, and in turn the pressure application piston 54 seated in a cushioned manner in the hollow body 51, downwardly until the hollow body 51 and the connecting bracket 53 reach the end position represented in FIG. 4, whereupon the support plates 45, 46 are released and then pivot in the direction H around their pivot point 59.

In the course of lowering the hollow body 51, the pressure application plate 56, which is tiltably arranged on the end of the pressure application piston 54, engages the empty tube 14. Thus, the spring element 55 arranged inside the hollow body 51 acts on the empty tube 14 via the pressure application piston 54, and the pressure application plate 56 thereon, and in turn also acts via the empty tube 14 on the gripper finger pairs 35, 36.

Because of the force of this action, the gripper finger pairs 35, 36 pivot downwardly and in the process lift the connecting element 41, 42 via the control linkage 39, 40. Here, the displacement path of the connecting elements is limited by the slides 43, 44, or by their elongated receiver slots 60.

Figure 5:
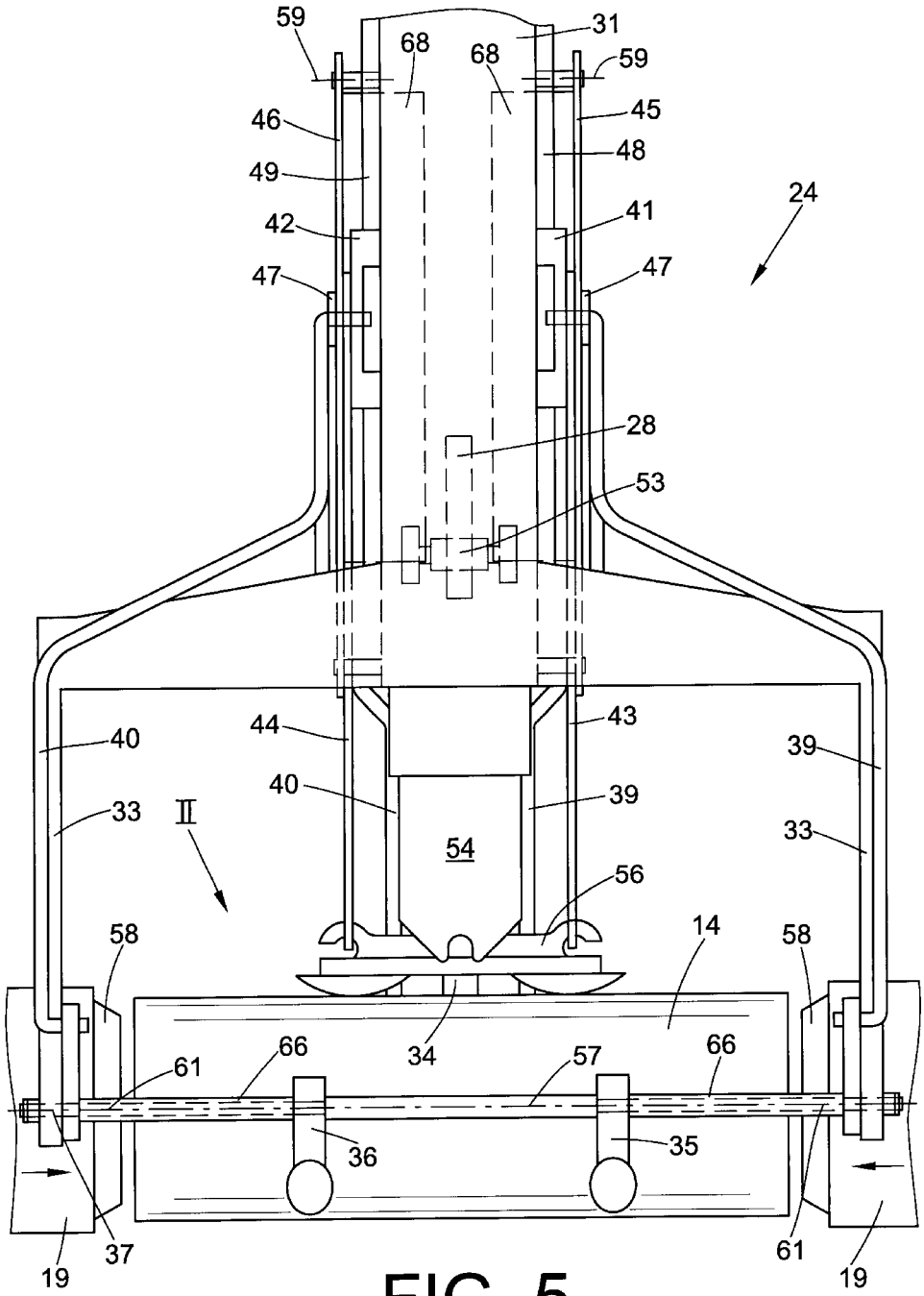
FIG. 5 is a front view of the tube gripper of FIGS. 3 and 4 as viewed from the direction X in FIG. 4.
Figure 5A:
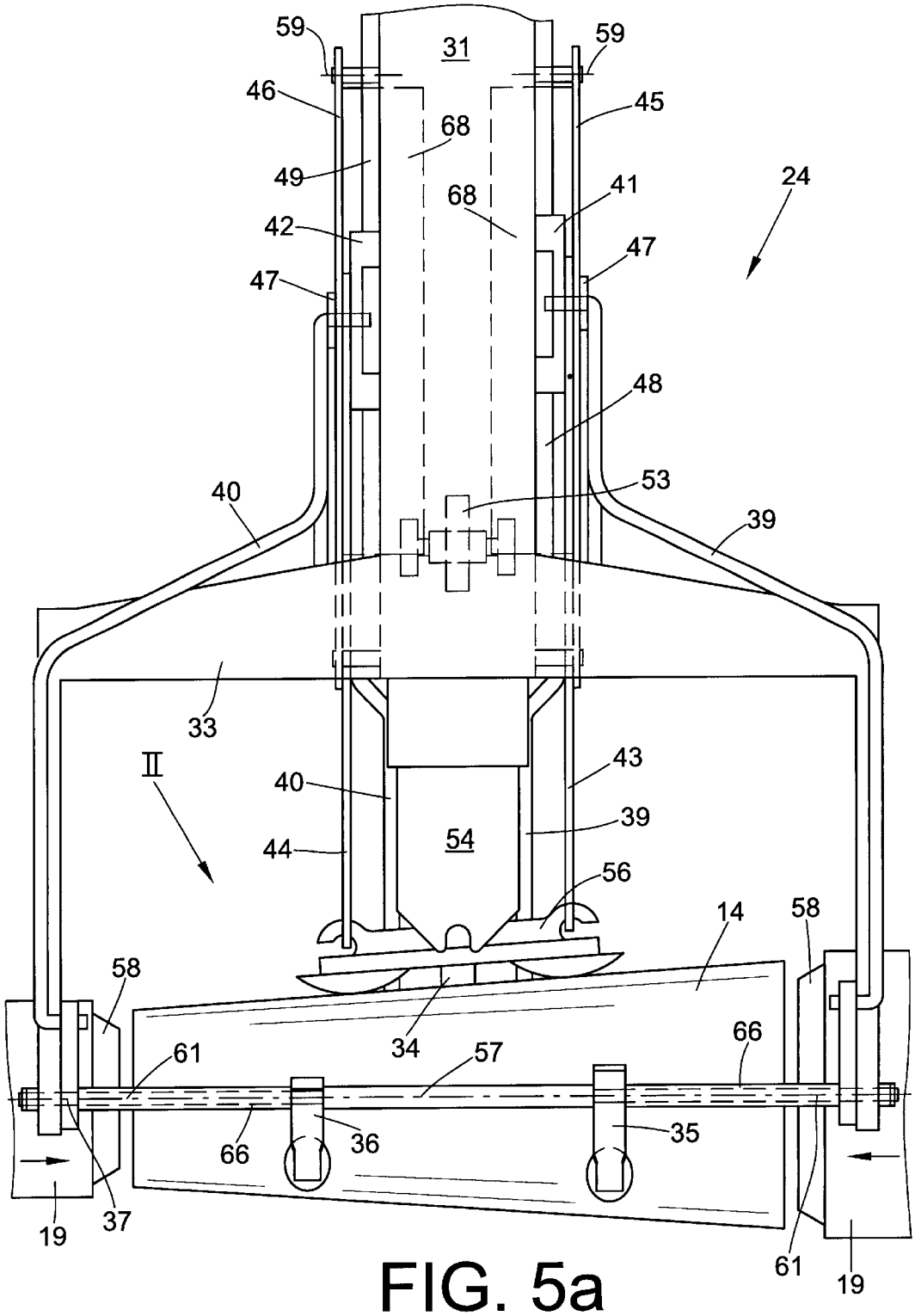
FIG. 5*a* is a front view of the tube gripper in accordance with FIG. 5, but with a conical empty tube.
Figure 6:
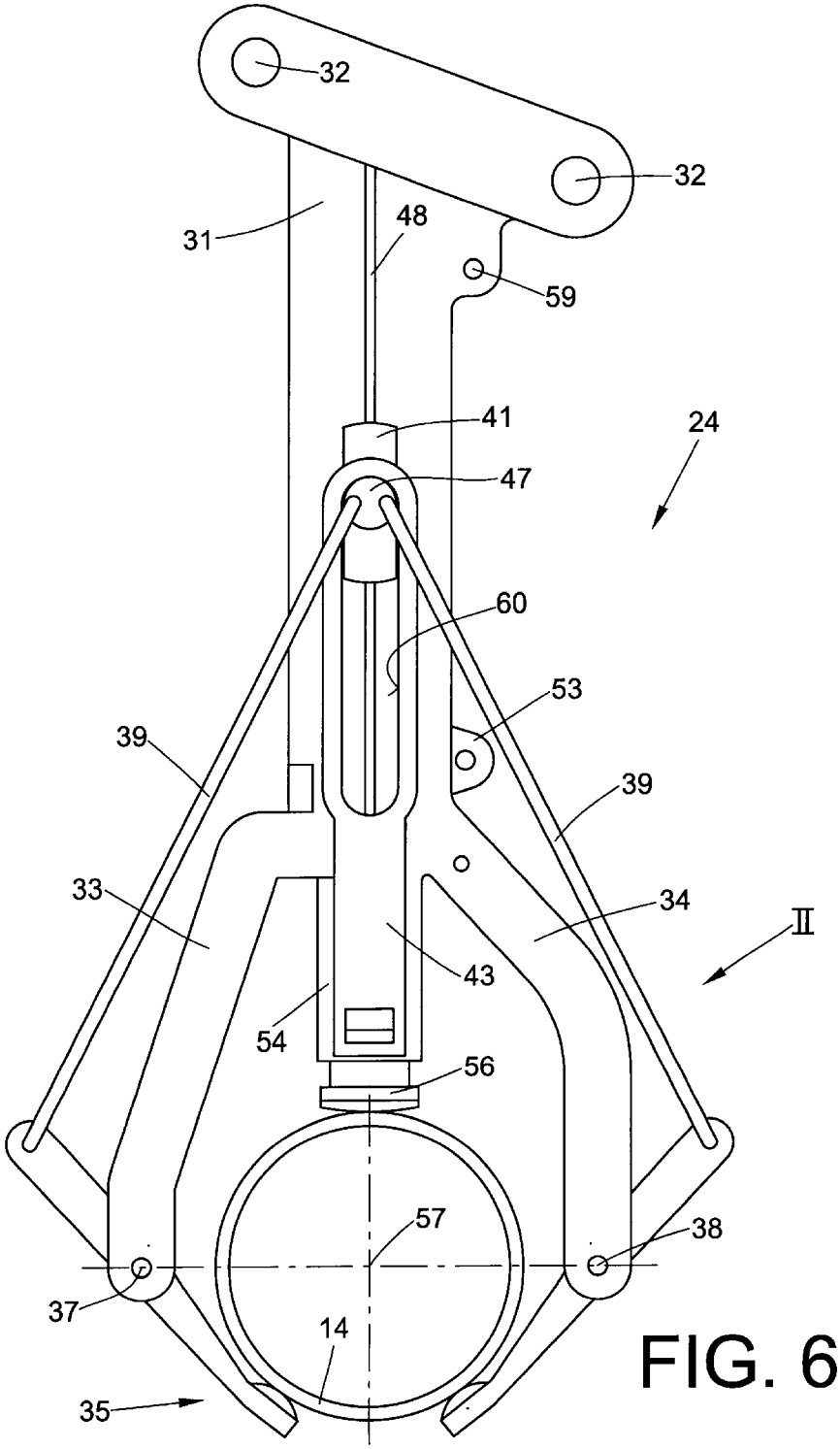
FIG. 6 is a further enlarged side view of the tube gripper in the tube transfer position of FIG. 4, wherein the representation of the holding plates has been omitted for reasons of clarity.

Thus, in the course of the displacement of the tube gripper 24 from its tube receiving position I into its tube transfer position II, in which the base body 31 of the tube gripper 28 is displaced in the direction V in the elongated guide slot 22 of the base frame 20, the shoulder 47 of the connecting elements 41, 42 rests against the upper edge of the elongated receiver slot 60 of the tongue-like slides 43, 44, such as is represented by way of example in FIGS. 5 and 5*a*. In the process, the empty tube 14 is placed in a position in which its center longitudinal axis 57 exactly coincides with the axis of rotation 61 of the tube receiving plates 58 of the creel 19, which at this time has also been pivoted into the tube transfer position II.

Thereupon, the empty tube 14 can be gripped without problems by closing the creel 19, and after the yarn being unwound from the spinning cop 9 and being kept in readiness at the winding device, as previously indicated, has been fixed in place on the empty tube 14, or has been clamped between the empty tube 14 and one of the tube receiving plates 58 of the creel 19, the tube 14 can be lowered onto the cheese drive roller 17.

The pairs of fingers 35, 36 open against the spring force of the spring element 55 in the course of this lowering movement of the empty tube 14 onto the cheese drive roller 17, whereby the control arm 25 of the control linkage 23 is removed from contact with the creel 19 in the course of the pivoting of the creel 19 into its winding position. Thereupon, the tube gripper 24 moves back into its initial, or base position represented in FIG. 3, which also represents the tube receiving position I, under the influence of the spring element 30.

In the course of pivoting into this tube receiving position I, the drive sleeves 66, which are arranged in the area of the pivot shaft 37 and are hinged on the gripper fingers, engage the closing and transfer elements 67, which are pivotably arranged on the tube reservoir 13. In the process, the closing and transfer elements 67 are pivoted in a manner such that the front one of the empty tubes 14 stored in the tube reservoir 13 is transferred to the gripper finger pairs 35, 36.

Thereupon, the tube change cycle is terminated and the tube feeding device 12 is ready for another tube transfer.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A tube feeding device for a work station of a cheese-producing textile machine having an arrangement for transferring an empty tube from a storage position in a tube reservoir into a tube transfer position for presentation to a pivotably seated creel between rotatable tube receiving plates thereof; the tube feeding device comprising a tube gripper for displacing a central longitudinal axis of the empty tube during a tube transfer operation such that, in the tube transfer position of the tube transferring arrangement, the central longitudinal axis of the empty tube exactly and continuously coincides with a common axis of rotation of the tube receiving plates of the creel, the tube gripper having a gripping mechanism which is self-adjustable conformable to various diameters and shapes of empty tubes for gripping and displacing empty tubes of differing diameters and shapes.

2. The tube feeding device in accordance with claim 1, characterized in that the tube gripper has a pressure application piston displaceable in a direction toward the empty tube and pairs of pivotable gripper fingers connected with the pressure application piston.

3. The tube feeding device in accordance with claim 2, characterized in that the pressure application piston is biased by a spring element within a hollow body which is slidingly guided in a receiving bore of a base body of the tube gripper.

4. The tube feeding device in accordance with claim 3, characterized in that a pivotably seated driving arm of a control linkage is hinged on a connecting bracket of the hollow body, the driving arm being disposed for engagement by the creel of the work station for displacement of the hollow body into a tube gripping position in response to movement of the creel into a winding position.

5. The tube feeding device in accordance with claim 3, characterized in that the base body of the tube gripper is moveable relative to a base frame of the tube feeding device.

6. The tube feeding device in accordance with claim 5, characterized in that a control linkage is arranged on the base frame of the tube feeding device and is connected with the base body of the tube gripper for displacing the base body and for actuation of the tube gripper between the tube receiving position and the tube transfer position.

7. The tube feeding device in accordance with claim 6, characterized in that the control linkage has a control arm disposed for engagement by the creel of a work station for movement of the control arm in response to movement of the creel in a winding position.

8. The tube feeding device in accordance with claim 5, characterized in that an electric drive mechanism arranged in the area of the base frame of the tube feeding device is connected with the tube gripper for displacement and actuation of the tube gripper between the tube receiving position and the tube transfer position.

9. The tube feeding device in accordance with claim 2, characterized in that a pressure application plate for engagement of the empty tube is arranged at the end of the pressure application piston to be tiltable in respect to the central longitudinal axis of the empty tube and is connected via tongue-like slides with the pairs of gripper fingers.

10. The tube feeding device in accordance with claim 9, characterized in that each of the slides has an elongated receiver slot defining limits to a displacement path of connecting elements for the gripper fingers.

11. The tube feeding device in accordance with claim 10, characterized in that each of the connecting elements is connected by a respective control linkages with one of the pairs of gripper fingers.

12. The tube feeding device in accordance with claim 11, characterized in that the slides, the connecting elements, and the control linkages cooperate for controlling the pairs of gripper fingers.

13. The tube feeding device in accordance with claim 10, characterized in that the connecting elements are slidingly guided on guide rails of a base body of the tube gripper.

14. The tube feeding device in accordance with claim 10, characterized in that the support plates fix the connecting elements in a position wherein the pairs of gripper fingers assume a tube receiving position.

15. A cheese-producing textile machine having a plurality of work stations and a plurality of tube feeding devices in accordance with said tube feeding device of claim 1, the plurality of the tube feeding devices being fixedly arranged on a crossbar of the textile machine disposed above the work stations.

16. A traveling service unit for a cheese-producing textile machine having a plurality of work stations for movement along the work stations and positioning as needed at any of the plurality of work stations, the traveling service unit comprising the tube feeding device in accordance with claim 1.

17. The traveling service unit in accordance with claim 16, characterized in that the service unit is supported by means of a running gear on a track arranged above the work stations of the cheese-producing textile machine and is connected with a central information system of the textile machine.

* * * * *